United States Patent [19]

Franco

[11] Patent Number: 5,074,714

[45] Date of Patent: Dec. 24, 1991

[54] INDEPENDENT SCUBA TANK STABILIZING/WEIGHT BALLAST FRAME

[76] Inventor: George Franco, 6693 Alcala Knolls Dr., San Diego, Calif. 92111

[21] Appl. No.: 567,008

[22] Filed: Aug. 13, 1990

[51] Int. Cl.[5] ..... B63C 11/30

[52] U.S. Cl. ..... 405/186; 114/315; 441/80

[58] Field of Search ..... 405/186, 185, 187; 114/315, 317, 331; 441/80

[56] References Cited

U.S. PATENT DOCUMENTS

| | | | |
|---|---|---|---|
| 2,968,159 | 1/1961 | Edmund | 405/186 |
| 3,228,080 | 1/1966 | Trauger | 405/186 X |
| 3,670,509 | 6/1972 | Walters | 405/186 |
| 3,842,611 | 10/1974 | Anderson | 405/186 |
| 3,967,495 | 7/1976 | Denis | 405/186 |
| 4,016,616 | 4/1977 | Walters | 405/186 |
| 4,455,718 | 6/1984 | Finnern | 405/186 |
| 4,608,940 | 9/1986 | Bulin | 114/331 X |
| 4,779,554 | 10/1988 | Courtney | 114/315 |
| 4,887,932 | 12/1989 | Toth | 405/186 |

*Primary Examiner*—David H. Corbin
*Assistant Examiner*—Arlen L. Olsen

[57] ABSTRACT

This assenbly (11) is an independent stabilizing/ballast weight frame (24) for under water scuba equipment. Frame (24) straps onto the external surface of any conventional scuba diving tank (22). Stabilizing legs (30L and 30R) provide a three point triangular support system to hold) the scuba tank (22) upright in a stable position with a lowered center of gravity. This aids the diver while he is getting into the equipment. Two separate and independent ballast weight modules (26L and 26R) attach to the frame (24). The weight ballast modules (26L and 26R) can be released by two separate and independent mechanisms. The weight frame (24) positions the ballast modules (26L and 26R) on either side and out in front of the divers waist to counterbalance the weight of the scuba diving tank (22), provide a low center of gravity and provide keel ballast in the horizontal swimming position. A waist belt (34) and frame (24) secures around the divers waist. Nylon lanyards and snap hooks (32L and 32R) are attached to each weight (26L and 26R). Each weight module (26L and 26R) attaches to the frame by means of a coupling (56L and 56R). The weights (26L and 26R) can be released simultaneously by squeezing the release handle (13). Individual release buttons (28L and 28R) will release either weight module (26L and 26R) independently. Each weight module (26L and 26R) has a nylon lanyard and snap hook (32L and 32R) to aid in equipment handling and or carrying accessory diving equipment. The snap hooks (32L and 32R) are located in a more visible position in front of the divers waist. The tank stabilizer/weight frame is designed to be used with jacket type buoyancy compensators (20).

11 Claims, 5 Drawing Sheets

INDEPENDENT SCUBA TANK STABILIZING/WEIGHT BALLAST FRAME

BACKGROUND

1. Field of Invention

This invention relates to scuba diving weight ballast systems used for buoyancy control and scuba tank stability.

2. Description of Prior Art

When scuba diving a diver must add negative weight ballast to his body and or equipment in order to descend below the surface of the water. The prior art form of negative ballast is normally a waist worn weight belt. This weight belt is usually left on the divers waist from the time he enters and exits the water. The weight belt adds a significant amount of "dead weight" to the diving equipment. This dead weight makes it difficult for a diver to exit the water and climb back into a boat while ocean diving. The one piece (waist worn) weight belts generally are to heavy and awkward to remove and install in the water. It takes two hands to attach the weight belt around the waist. It is almost impossible to attach the belt while floating in the water. This prior art form also makes it difficult for a diver to stand and walk erect while beach diving or getting into the equipment on a pitching boat. The diver must lean forward (hunch backed) to counterbalance the weight of the scuba tank which is pulling him backwards.

The traditional art form (waist worn weight belts) also rub and bang against the divers hips while making ascents and descents. This has a tendency to make diving uncomfortable. This art form also places the divers body in tension because the weights are pulling him down from the waist while the buoyancy compensator is lifting him up from the shoulders and upper torso. This causes undue muscle fatigue.

Getting into the scuba diving tank on a pitching boat while ocean diving can be very difficult for a scuba diver. The scuba tank and attached related equipment generally have a very high center of gravity. The tank itself has a small circular bottom which does not provide good stabilty in the upright position while a diver is getting into the equipment. It is not unusual that a diver must have help to get into the equipment under these conditions. An assistant must hold the tank steady while the diver gets into the shoulder and waist straps to secure the tank to his body.

Several different types of tank mounted weight ballast systems have been proposed- for example U.S. Pat. No. 3,967,459 (1961) to Denis and U.S. Pat. No. 4,455,718 (1984) to Finnern. Although this prior art does propose a way to add ballast to the frame or scuba tank, most of these designs suffer from the following disadvantages:

a. Ballast weights generally can only be released when the tank is in the vertical position.

b. The release mechanism is in an awkward position that may be impossible for a diver to see and reach.

c. Only one release mechanism is provided with no secondary or "fail safe" independent backup system.

d. The ballast weights are not positioned with a "systems engineering" approach to counterbalance undesirable moments and forces.

e. None of the prior art shows an attempt to use the ballast weights for secondary purposes such as providing vertical tank stability to aid the diver while getting into the equipment.

f. None of the prior art adds weight ballast below the divers center of gravity in the horizontal plane (keel ballast) to give him roll stability.

g. All of the prior art form suspends the scuba tank weight on the divers shoulders giving him a high and unstable center of gravity out of the water.

h. Previous art form releases all of the ballast weight at one time in emergency conditions.

OBJECTS AND ADVANTAGES

Briefly, there is provided in accordance with the present invention a scuba tank stabilizing/weight frame. The weight frame straps onto the external surface of a conventional scuba tank and provides a three point triangular platform to hold the tank stable in an upright position while the diver is getting into the equipment. The frame also provides an attachment point for two separate weight ballast modules. The weight modules are adjustable for ballast weight to suit individual diving requirements. The weight modules can be removed and reattached by the diver while on land or in the water. The weight modules are positioned such that they counterbalance (or equalize) the weight of the scuba tank such that a diver can stand and walk erect while on land or on a boat. Furthermore, while in water the weight modules are positioned such that they provide the diver with negative ballast that is below his center of gravity (while swimming horizontally) which makes him more stable in the water.

The invention features a quick disconnect male/-female coupling that provides two different and separate mechanical methods to release the weight modules. The coupling design consists of a female socket which embodies the release claw and a male retention stud which is attached to the weight module.

The weight frame can also be used to stow the weight modules behind the diver in the small of his back. When used in this manner the diver is equipped for "skin diving and snorkeling". Because the weights are carried behind the divers waist, his lower back, legs and swim fins are submerged deeper in the water. This feature gives the diver more surface swimming power because his swim fins work more effectively.

Additional objects and advantages of the present invention are the following:

a. to provide weight ballast modules that can be released from any position.

b. to provide two separate and independent ballast release mechanisms that are visible and readily accessible to the diver.

c. to provide a "systems engineering" approach to integrate the center of gravities and center of buoyancies of the following items: ballast weights, scuba diving tank, buoyancy compensator, scuba diver/wet suit.

d. to provide a three point stabilizing support frame which uses the ballast weights to make the scuba tank stable in the vertical position.

e. to provide a lower back support frame and waist belt that transfers equipment weight from the divers shoulders down to his hips.

f. to provide the scuba diver with roll stability while swimming in the horizontal plane.

g. to provide a scuba diver with the option to release one half (50%) of his ballast weight to make a slower and safer emergency ascent.

h. to provide weight ballast modules that can be attached or released to a supporting frame by using one hand only.

i. to provide a snorkeling/skin diving weight ballast system that gives the diver increased swim fin effectiveness.

DRAWING FIGURES

The present invention will be best understood by reading the following detailed description taken in connection with the accompanying drawings wherein.

DESCRIPTION

FIGS. 2 to 5

Figure 2:
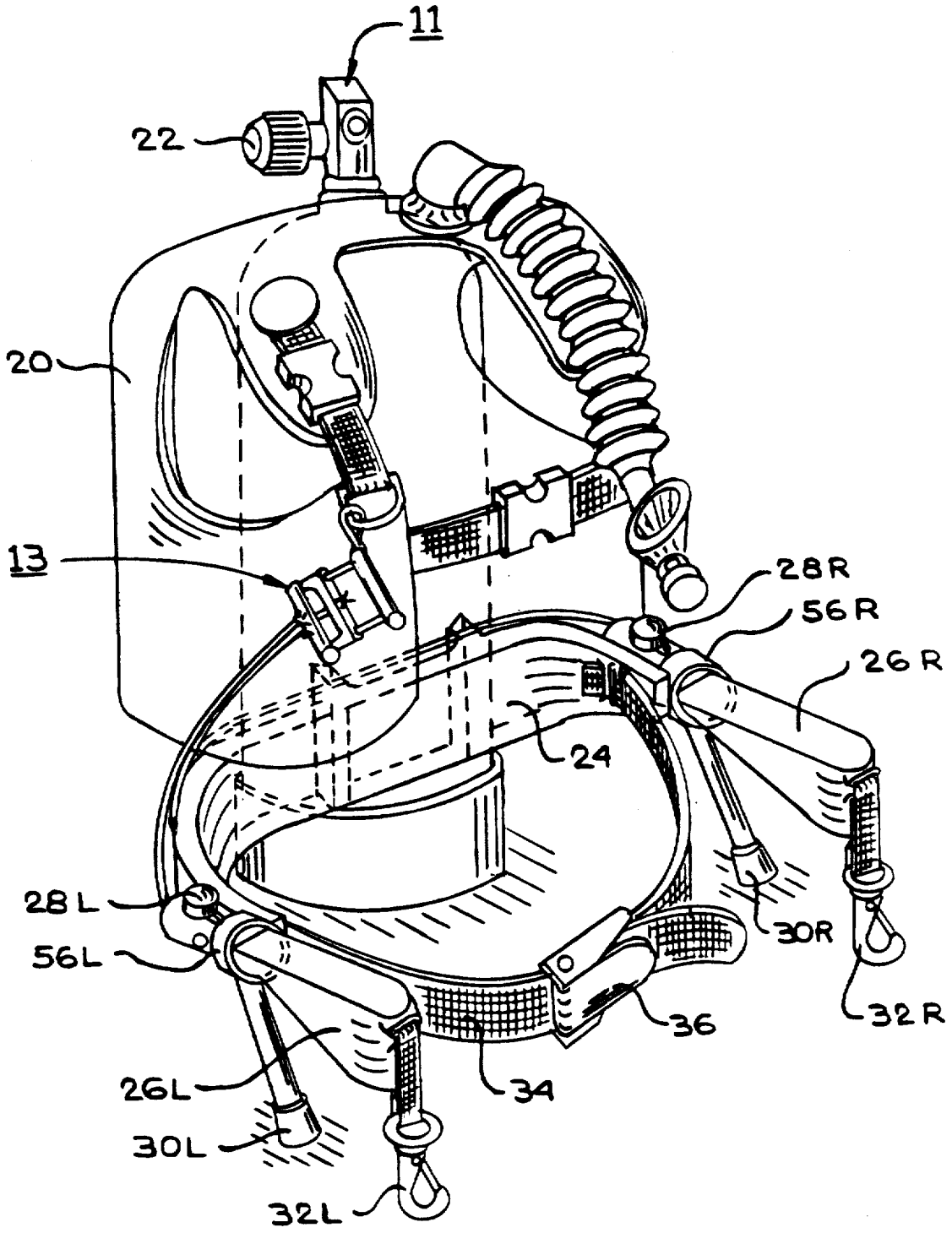
FIG. 2 is an isometric view showing a scuba tank, weight frame, buoyancy compensator and weight modules.

Referring to FIG. 2 an assembly is shown (11) which consists of scuba diving air tank (22), wrap around jacket type buoyancy compensator (20), weight frame (24), two weight modules (26L and 26R) and release handle (13). The assembly is shown standing in the vertical position on a flat surface. The assembly is supported in the upright position by means of the air tank bottom and two support legs (30L and 30R). This provides a three point triangular system to stabilize the assembly while the diver gets in and out of the equipment.

Figure 3:
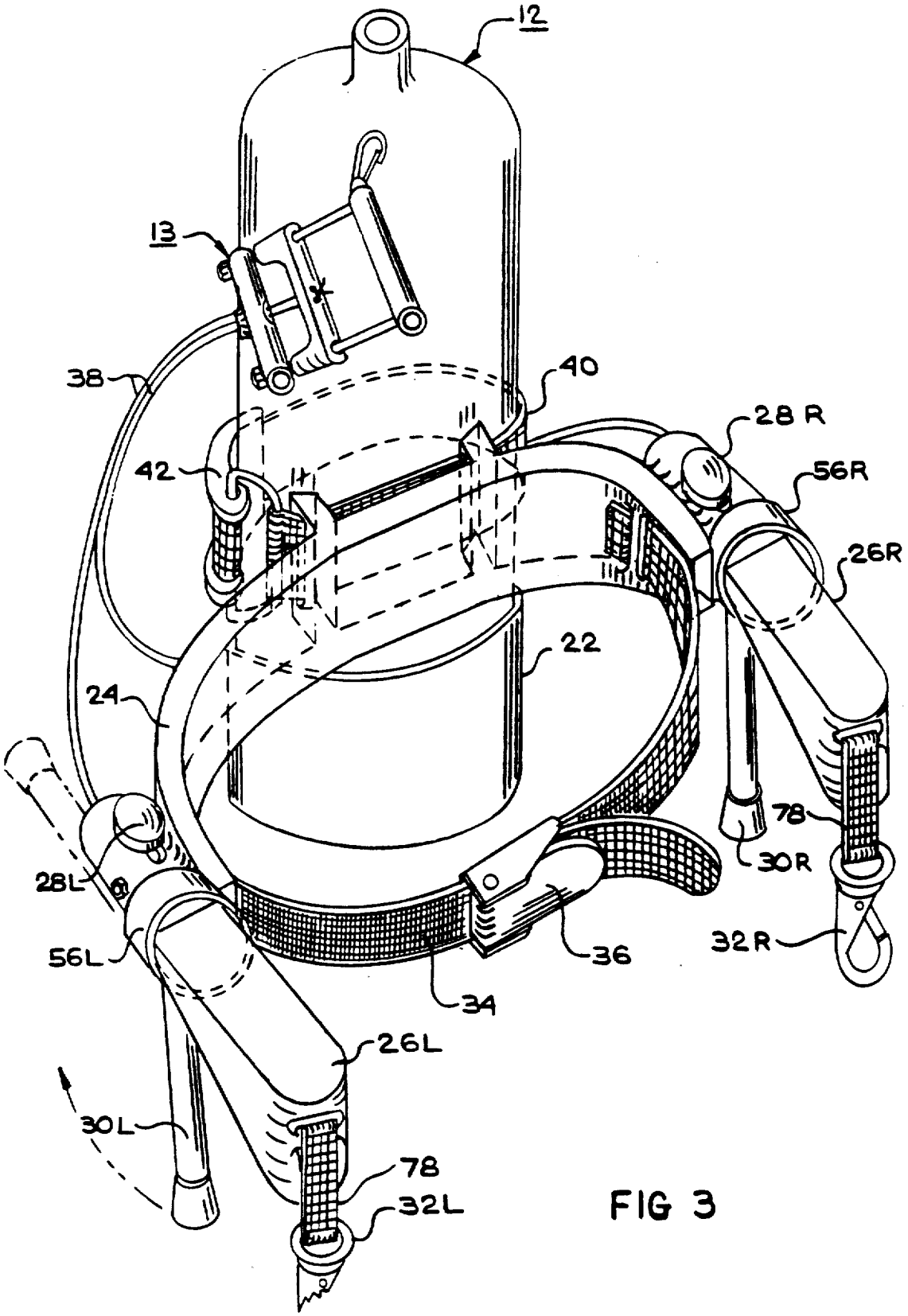
FIG. 3 is an isometric view which shows the weight frame and scuba tank.

Referring to FIG. 3, an assembly is shown (12) which represents the stabilizing/weight ballast frame (24) secured to the scuba air tank (22). The frame is secured to the air tank (22) by means of a flexible two inch wide nylon strap (40). The nylon strap is drawn tight around the air tank (22) by means of a locking cam buckle (42). The cam buckle (42) is currently used in the diving industry to secure equipment. The frame (24) has two protruding "vee" shaped surfaces which mate with the cylindrical surface of the scuba air tank (22). These surfaces and the circumferential strap draw the two units together as a rigid body. The left and rights ends of the frame (24) have molded slots proportioned such that a standard two inch wide nylon webbing (34) can be threaded and retained into the frame. A cam locking buckle (36) serves to connect the two pieces of webbing together. The buckle (36) and nylon webbing (34) attach around the divers waist. The frame (24) and nylon webbing (34) encircle the divers waist thereby attaching the assembly (12) to him. Two weight modules (26L and 26R) attach to the frame by means of quick disconnect couplings (56L and 56R). The weight modules (26L and 26R) are jettisoned by lifting up on the release buttons (28L and 28R) or squeezing the release handle (13). The release handle (13) is attached to each coupling by means of a flexible cable (38). The flexible cable (38) is similar to those used for bicycle breaks. Two snap hooks (32L and 32R) are attached to the weight modules (26L and 26R) by means of one inch wide nylon webbing (78). The nylon webbing (78) is sewn with loops at each end to attach the snap hook (32L and 32R) to the weight modules (26L and 26R). Support legs (30L and 30R) attach to the frame (24) and can be folded up and back when not in use.

Figure 4A:
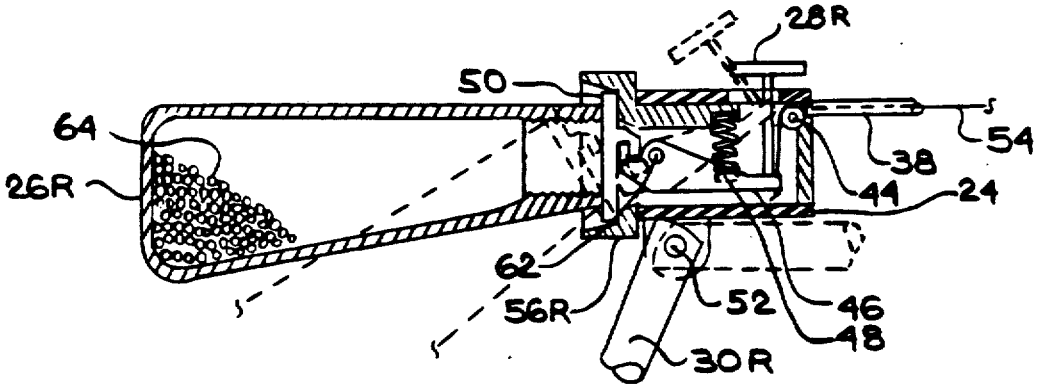
FIG. 4A is a crossectional view of the disconnect coupling and weight module.
Figure 4B:
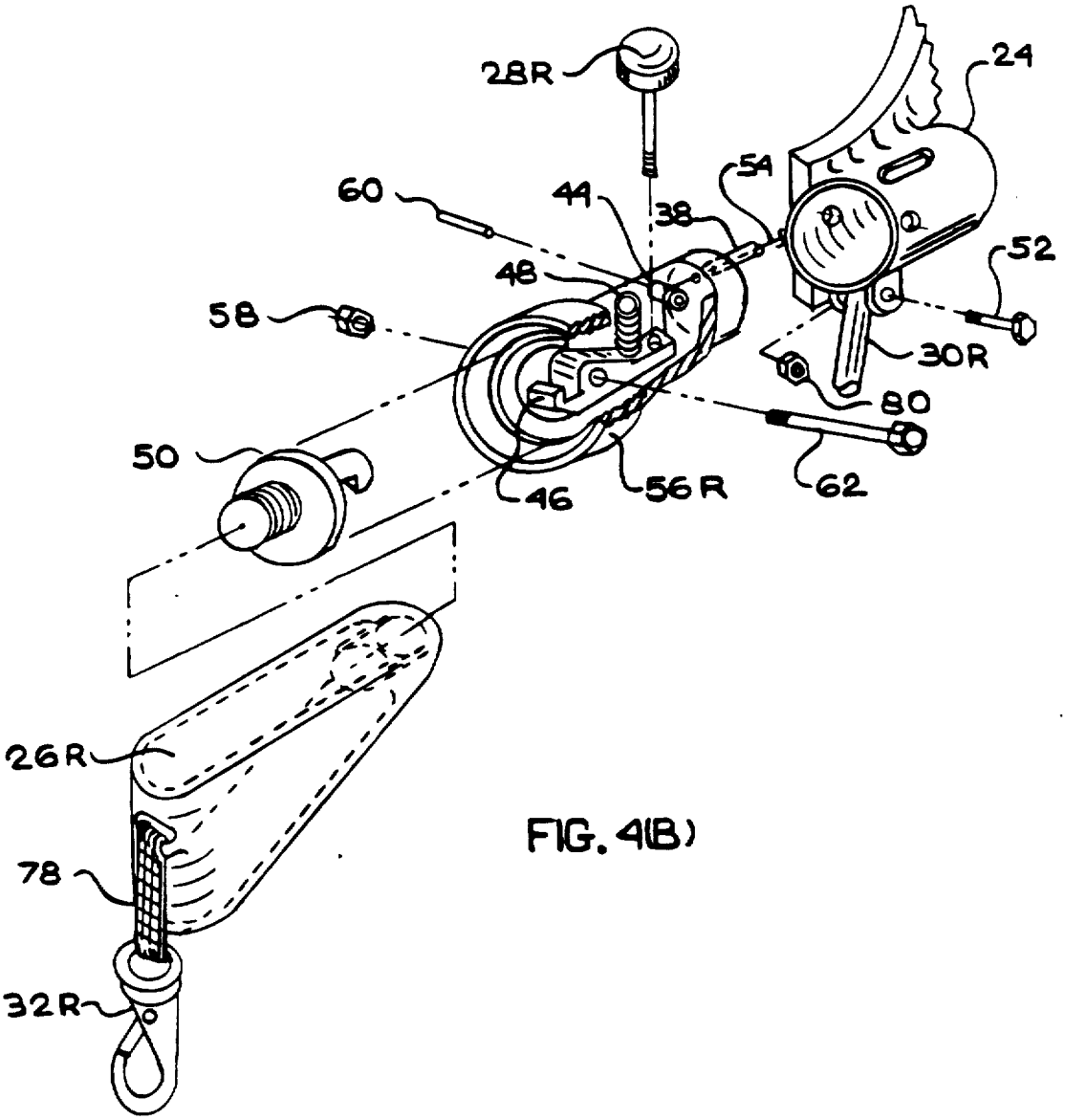
FIG. 4B is an exploded view of the disconnect coupling and weight module.

Referring to FIG. 4A a crossectional view is shown of the coupling housing (56R) and its internal parts. FIG. 4B is an exploded view showing how the parts fit together. These two figures will aid the reader in understanding the following description. A retention claw (46) is retained in the coupling housing (56R) by means of a pivot bolt (62) and nut (58). The bolt (62) also retains the coupling housing (56R) into the cylindrical tube molded into the frame (24). A release button (28R) threads into the retention claw (46). Lifting up on the release button (28R) causes the claw (46) to rotate about the pivot bolt (62) to the open position. Also attached to the end of the retention claw (46) is a Dacron lanyard (54). The lanyard passes through a hole in the retention claw (46) and is tied off with a knot. The lanyard (54) passes over a cylindrical roller (44) and through a flexible cable (38). Linear movement of the lanyard (54) causes the retention claw to rotate to the open position. A compression spring (48) returns to claw to its closed and locked position. The compression spring (48) fits in two counter bores: one in the housing (56R) and one in the retention claw (46). FIG 4A shows the retention claw (46) in the open and released position with dashed lines.

Mating to the retention claw (46) is a retention stud (50). Attached to the retention stud is a weight module (26R). The weight module (26R) is blow molded from plastic material thereby providing a hollow chamber. This chamber is filled with lead shot (64) which provides the negative weight ballast required for diving. The retention stud (50) threads into the weight module (26R) and thereby closes off the opening of the weight module (26R) and retains the lead ballast (64) into the hollow chamber.

Two parallel and mating surfaces between the retention claw (46) and the retention stud (50) secure the weight module (26R) into the coupling housing (56R). The retention stud (50) has a cylindrical disk which fits inside the coupling housing (56R) counterbore until it stops flush with the mating surface. The force of gravity will cause the weight module (26R) to fall away any time the retention claw (46) is rotated to the open position.

FIG. 4A also shows a folding support leg (30R) attached to the frame housing (24). The support leg (30R) is attached by a pivot bolt (52) and nut (80). The support leg (30R) is pinned to the frame housing (24) between two double shear clevis tabs. The clevis tabs are molded extensions of the frame housing (24). As can be seen in FIG. 4A, the top surface of support leg (30R) is sloped and curved. This curve provides for both rotation to fold leg (30R) and as a stop for the forward movement.

Figure 5A:
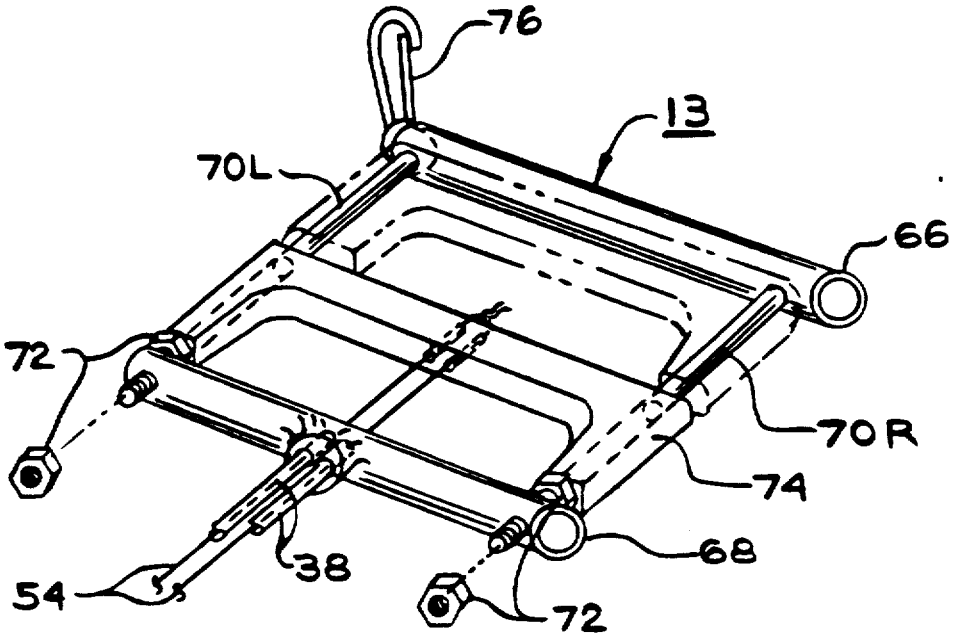
FIG. 5A is an isometric view of the "squeeze to release" handle.

Referring to FIG. 5A, an isometric view of the "squeeze to release" handle assembly (13) is shown. The handle consists of two parallel slider rods (70L) and (70R), a top handle bar (66), a bottom cable anchor bar

(68) and a sliding release bar (74). A snap hook (76) is attached to the top handle bar (66) by means of a molded press fit socket. The top handle bar (66) and parallel slider rods (70L and 70R) are one monolithic molded part. The bottom cable anchor bar (68) is attached to each parallel slider rod (70L and 70R) by jam and lock nuts (72). The ends of the slider rods (70L and 70R) are threaded to accept the jam and lock nuts (72). The sliding release bar (74) has two molded clearance holes that allow the slider rods (70L and 70R) to pass through freely. The bottom cable anchor bar (68) has a solid center section with two molded counterbores. The flexible cables (38) are press fit into each counterbore. The counterbores serve to restrain the end of each cable (38). The center of each counterbore is drilled with a through hole to allow each flexible Dacron lanyard (54) to pass through and into the sliding release bar (74). The sliding release bar contains two clearance holes which allow the lanyards (54) to pass through. The lanyards (54) are tied off with knots around the sliding release bar (74). The sliding release bar (74) is shown in two positions: closed and locked and the released position. The sliding release bar (74) is moved to the released position by hand squeezing action between the top handle bar (66) and the sliding release bar (74).

Figure 5B:
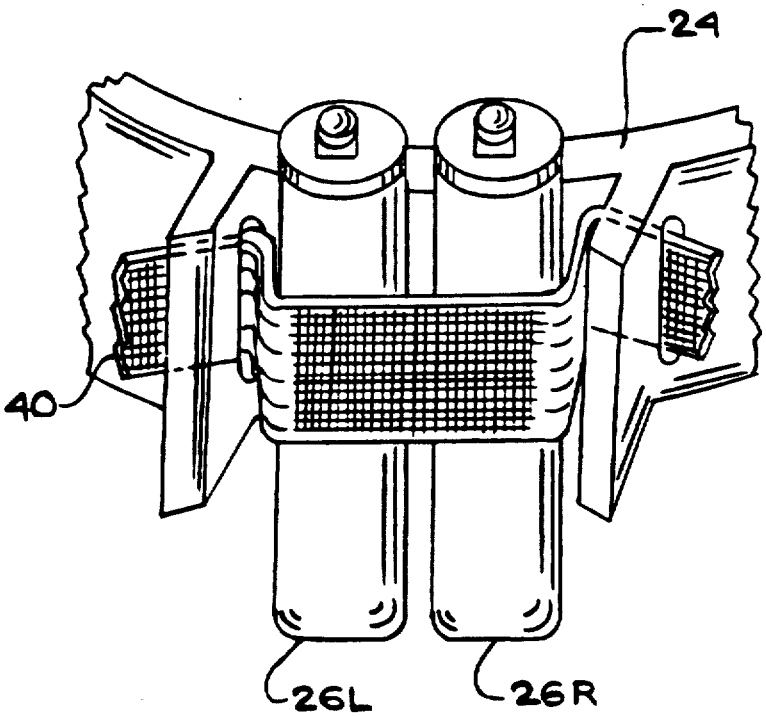
FIG. 5B is an isometric view of the back of the weight frame showing the weight modules in the stowed position for snorkeling/skin diving.

Referring to FIG. 5B, the weight modules (26L and 26R) are shown in the stowed position on the back side of the frame (24). The same two projections that mate with the cylindrical surface of the scuba air tank also provide a pocket for the two weight modules (26L and 26R) to stow into. The weight modules (26L and 26R) are retained by the two inch wide nylon webbing strap (40). The cam locking buckle (42) and air tank (22) is not shown for clarity.

The frame (24) can be designed in mulitple sections such that the width is adjustable to fit different divers waists. All structural parts discussed thus far can be molded from high strength and high impact plastics. Materials such as Delrin and polypropolene are currently used in the industry. They would also be suitable for this invention.

OPERATIONS

FIGS. 1, 2, 3, 4, 5

During normal use when a scuba diver is getting dressed to scuba dive he must strap himself into a scuba tank. The present art form generally uses a back pack arrangement which secures the tank to the divers back with shoulder and waist straps. When worn in this manner the diver is carrying the full weight of the scuba tank on his shoulders. This gives the diver a very high center of gravity and the weight of the scuba tank pulls him backward unless he leans forward to counter balance the weight. Beach diving and boat diving can become very difficult with this art form.

The present invention allows the diver to carry all of the weight down low on his hips. Referring to FIG. 2 the weight ballast frame (24) and waist belt (34) are designed to transfer the weight to the divers hips. This lowers the divers center of gravity and gives him more stability. The shoulder straps on the buoyancy compensator (20) serve to balance the equipment weight but not suspend it from the divers shoulders. An equipment weight of approximately 60 pounds is common. Also, the weight modules (26L and 26R) are positioned on the frame 24 such that they counter balance the weight of the scuba tank. Therefore, the diver can stand and walk erect. The invention uses the concept of moments (ref: Engineering Mechanics by T. C. Haung) to position the weights at calculated distances away from the scuba tank center of gravity. This calculated distance significantly reduces the bending moments that tend to make the diver unstable. The same counter balance effect gives the diver more swimming stability in the horizontal position because the ballast weights are below the divers center of gravity.

Figure 1A:
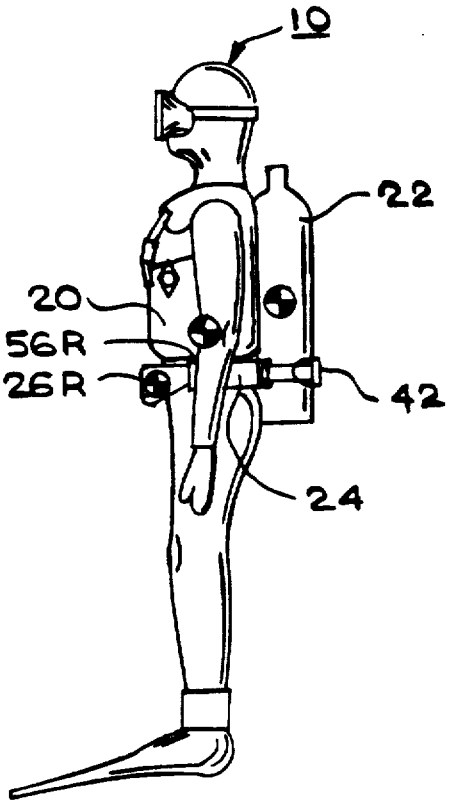
FIG. 1A is a side view of centers of gravity and bouyancy of a diver while standing.
Figure 1B:
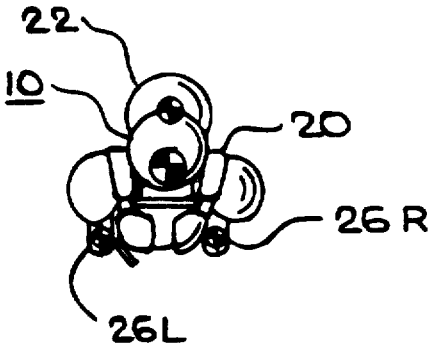
FIG. 1B is a top view of centers of gravity and buoyancy of a diver.
Figure 1C:
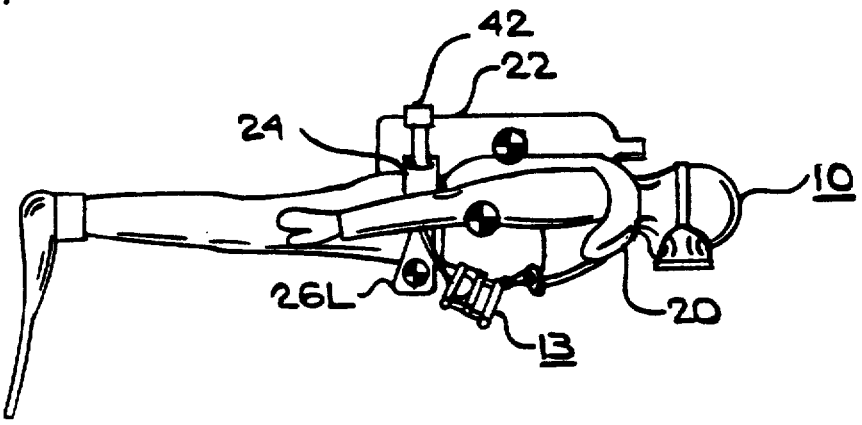
FIG. 1C is a side view of centers of gravity and bouyancy of a diver while swimming.

Referring to FIGS. 1A-C, a scuba diver is shown wearing the major pieces of heavy equipment required for diving. Scuba tank (22) buoyancy compensator (20), weight modules (26L and 26R) and diver (dressed in a wet suit) represent the major centers of gravity and buoyancy. The invention uses a "systems engineering" approach to balance and integrate all these centers of gravity and buoyancy together. Views A, B, and C show the system (10). The weight frame (24) is secured to the scuba tank (22) by means of a nylon strap and over center buckle (42). Weight modules (26L and 26R) attach to the weight frame (24) by means of couplings (56L and 56R). The weight modules (26L and 26R), weight frame (24) and scuba tank (22) all become a rigid body. The centers of gravity and buoyancy of the system are therefore linked together.

Referring to FIG. 1 view A, the system is shown in the vertical position out of the water. The center of gravity for both the weight module (26R) and scuba tank (22) are shown. Both centers of gravity are acting downward due to gravity. However, because they are now linked together as a rigid body the bending moments are now cancelled out and the diver may stand erect. The diver's back becomes a neutral plane with no undue bending moments acting on this back.

FIG. 1 view B shows the diver swimming in the horizontal plane. Note that the center of gravity of the weight modules (26R and 26L) is below the diver's center of gravity. This has the same effect as adding keel ballast to a sail boat. The invention thereby provides more swimming stability during surging ocean conditions.

FIG. 1 view C shows a side view of the diver swimming in the horizontal plane. The release handle (13) is shown attached to the buoyancy compensator (20). In emergency conditions both weight modules (26L and 26R) can be jettisoned by squeezing the release handle (13). The weight modules (26L and 26R) will release from any position.

Referring to FIG. 3, the weight modules (26L and 26R) are designed to be removable and reattachable and they divide the required ballast weight in two equal masses. This safety feature will allow the diver to make a less rapid ascent under emergency conditions. A less rapid ascent will reduce the possibility of air embolism. The PADI/NAUI organizations recommend that a diver jettison 12 pounds of his ballast weight rather than all of it. The previous art form forces the diver to jettison all of the ballast weight at one time. The present art form (waist worn weight belts) also forces the diver to carry all of the ballast weight in one belt around his waist. This weight is normally 20 to 28 pounds and is awkward and difficult to handle in or out of the water. For this reason most divers leave their weight belts on while climbing back up into a boat while ocean diving. The present invention allows the diver to remove his ballast while still in the water by removing one weight module (one half of the weight) at a time. This is accomplished by lifting the release button (28L or 28R) up while holding onto the handling strap (78L or 78R). The weight module (26L or 26R) can then be handed to someone or attached to a support line from the boat. This feather allows the diver to come out of the water with reduced equipment weight (approximately 20 to 28 pounds less) which makes diving safer and easier.

The present invention also provides a three point support system to hold the scuba tank upright while the diver is getting into the equipment. The support legs (30L and 30R) and the bottom of the scuba tank (22) form a triangular three point system that holds the tank stable. With the weight modules (26L and 26R) attached to the frame (24), the scuba tank (22) has a lower center of gravity and stable configuration. A diver can get into his equipment safely and conveniently without help from an assistant.

During diving conditions the weight modules (26L and 26R) can be removed by two different and independent mechanical devices. For emergency conditions the squeeze handle (13) will release both weights at the same time. To remove or reinstall either of the weight modules (26L or 26R), lifting of the release button (28L or 28R) will cause the individual weight to fall free from any position. The diver can be horizontal, vertical or any combination of positions and the weight modules (26L or 28R) will still release and fall free of the divers body. To reinstall the weight module (28L or 28R) the diver can use one hand to plug the weight back into the coupling (56L or 56R). The weight will automatically lock itself in the socket when the two coupling faces contact each other. This differs from the previous art form (weight belts) which require two hands to attach them around the waist.

Referring to FIG. 5B a view is shown of the back of the frame (24) with the two weight modules (26L and 26R) stowed in position for free diving and snorkeling. The frame retention strap (40) is used to secure the weight modules (26L and 26R). The frame (24) can then be worn around the divers waist. When used in this manner it will place ballast weight in the small of the divers back causing his swim fins to be totally submerged in the water and therefore more effective.

SUMMARY, RAMIFICATIONS, AND SCOPE

Accordingly, the reader will see that the scuba tank/-weight ballast frame can be used to enhance the sport of diving by making it safer and more convenient. The ballast weights can be jettisoned by two different and independent methods. The ballast weights are used to advantage in reducing bending moments, lower the centers of gravity and provide for scuba tank stability while the diver is getting into the equipment.

While the present invention has been described in connection with a particular embodiment thereof, it will be understood by those skilled in the art that many changes and modifications may be made without departing from the true spirit and scope of the present invention. Therefore, it is intended by the appended claims to cover all such changes and modifications which come within the true spirit and scope of this invention.

I claim:

1. A waist worn belt used in scuba and skin diving applications, comprising:

a rigid semicircular segment for partially encircling a divers middle torso;

a flexible webbing segment which completes encirclement and fastens tightly by means of a cam locking buckle;

a second flexible webbing strap threaded through said rigid segment and encircling a scuba air tank holding said scuba tank rigidly to said segment;

at least one short support appendage providing a substantial geometric base for supporting said scuba tank vertically from a flat surface, said appendage capable of folding to different positions;

at least one hollow chamber of adequate volume with one opening to contain ballast weight;

at least one coupling having a male retention stud, a female socket with self alignment features, a pivoting beam having a claw like end mating with said retention stud;

a release handle connected to said coupling by a flexible cable and lanyard, whereby squeezing action on said handle pivots said beam thereby releasing said retention stud.

2. The belt of claim 1 wherein said weight ballast attached to said belt counterbalances the bending forces of said scuba tank.

3. The belt of claim 1 wherein said weight ballast is adapted to be attached or separated from said belt by a diver using only one hand.

4. The belt of claim 1 wherein said belt is designed to be used in conjunction with a jacket type wrap around buoyancy compensator.

5. The belt of claim 1 wherein said attached weight ballast lowers the center of gravity of both the said scuba tank and the scuba diver.

6. The belt of claim 1 wherein said belt transfers substantial equipment weight away from the divers shoulders down to the hips.

7. The belt of claim 1 wherein at least one said chamber contains a plurality of lead weights stowed in a secondary position on the back side of said rigid semicircular segment by means of said second flexible webbing strap.

8. A diver's backpack comprising:

a belt having a first rigid portion and a second flexible portion adapted for encircling a scuba diver's torso;

ballast weight, attached to said belt;

means, connected to the first rigid portion of said belt; for attachment of a scuba tank to said belt; and support means, pivotally connected to the rigid portion of said belt, for forming a support base with said scuba tank when placed on a horizontal surface.

9. A diver's backpack comprising:

a belt having a forward flexible portion and a rearward rigid portion adapted for encircling a scuba diver's torso;

a ballast weight container coupled to each end of the rigid portion of said belt and extending forwardly therefrom, whereby said container can be filled with ballast weight so as to counterbalance a scuba diver's and a scuba tank's centers of gravity; and means, connected to the rigid portion of said belt, for attachment of a scuba tank to said belt.

10. The diver's backpack of claim 9 wherein the ballast weight container is filled with lead shot.

11. The diver's backpack of claim 9 including a squeeze handle connected to said ballast weight container.

* * * * *